US005107761A

United States Patent [19]

Greive

[11] Patent Number: 5,107,761

[45] Date of Patent: Apr. 28, 1992

[54] FRICTION ROLLER FOR THE INKING OR MOISTENING UNIT OF PRINTING PRESSES

[75] Inventor: Martin Greive, Am Bächenbuckel, Fed. Rep. of Germany

[73] Assignee: Heidelberger Druckmaschinen AG, Heidelberg, Fed. Rep. of Germany

[21] Appl. No.: 565,678

[22] Filed: Aug. 10, 1990

[30] Foreign Application Priority Data

Aug. 22, 1989 [DE] Fed. Rep. of Germany ..... 3927664

[51] Int. Cl.[5] ..... B41F 7/26; B41F 7/40; B41F 31/14

[52] U.S. Cl. ..... 101/148; 101/350; 101/DIG. 32

[58] Field of Search ..... 101/148, 348, 349, 350, 101/351, 352, 207-210, 218, 247, DIG. 32, DIG. 38

[56] References Cited

U.S. PATENT DOCUMENTS

| | | | |
|---|---|---|---|
| 2,581,687 | 1/1952 | McWhorter | 101/348 |
| 4,351,236 | 9/1982 | Beisel et al. | 101/352 |
| 4,711,171 | 12/1987 | Theilacker | 101/148 |

FOREIGN PATENT DOCUMENTS

| | | |
|---|---|---|
| 8626762 | 1/1987 | Fed. Rep. of Germany . |
| 3540912 | 5/1987 | Fed. Rep. of Germany . |
| 655867 | 8/1951 | United Kingdom . |
| 2197261 | 5/1988 | United Kingdom . |

*Primary Examiner*—J. Reed Fisher
*Attorney, Agent, or Firm*—Nils H. Ljungman & Associates

[57] ABSTRACT

A friction roller for the inking or moistening unit of a printing press, the roller axle of which is mounted on the side frames of the printing press, and the roller body of which is driven through frictional engagement by the inking or moistening unit roller, the roller body executing a to-and-fro movement on the roller axle in its rotation, in such a manner that the lateral stroke movement of the roller body can be controlled and executed with any desired frequency.

21 Claims, 3 Drawing Sheets

FRICTION ROLLER FOR THE INKING OR MOISTENING UNIT OF PRINTING PRESSES

BACKGROUND OF THE INVENTION

1. Field of the Invention

The present invention relates to a friction roller for the inking unit or the moistening unit of a printing press, the roller axle of which is mounted in the lateral machine housings (or side frames) of the printing press, and the roller body of which is driven by an inking unit roller or a moistening unit roller through a frictional engagement therewith, the friction roller thereby executing a to-and-fro movement on the roller axle in its rotational movement.

2. Background Information

A friction roller is disclosed in German Utility Model No. 86 26 762. In general, such friction rollers even out the ink application in the inking unit, and can also even out the film of moistening agent in the moistening unit, such that appearances of atencilling are minimized on the printing plate or on the printed image. In the friction roller disclosed in German Utility Model No. 86 26 762, the lateral stroke movement and also the stroke frequency are unspecified, so that an adjustment for the specific conditions of printing technology is not possible. However, a targeted lateral trituration (or mixing), which cannot be implemented with the friction roller shown in German Utility Model No. 86 26 762, offers considerable advantages, particularly in the case of printing presses used to produce very high quality prints.

OBJECT OF THE INVENTION

An object of the present invention is the provision of a friction roller for the inking or moistening unit of printing presses which allows the execution of a controlled lateral stroke movement, wherein the lateral stroke movement can be specified with substantially any desired frequency.

SUMMARY OF THE INVENTION

In general, the invention features a roller axle having eccentric bearings in the area of the lateral machine housings, the eccentricity of the bearings being offset in opposite directions by 180 degrees; rocker bearings provided on the eccentric bearings, guided in a slot in the lateral machine housings, whereby the slots run parallel to the central unit between the friction roller and the interacting inking or moistening unit roller; the provision, on both sides, in the area of the lateral machine housings, of levers which are mounted swivellably on the mounting of the inking or moistening unit roller, and which encompass the roller axle at the opposite end in order to produce the adjusting pressure; and wherein the roller axle is driven through a step-down gear system by the inking or moistening unit roller. In such a construction, the lateral stroke movement can be influenced by the degree of eccentricity of the bearings, i.e., the greater the eccentricity, the greater the lateral stroke at a given ratio of transmission. In addition, the step-down ratio with which the roller axle is driven can be determined by appropriate driving gears, so that the stroke frequency of the lateral movement of the friction roller can be adjusted precisely to the technological printing requirements. The slight inclination of the friction roller in relation to the inking or moistening unit roller interacting with it, which occurs periodically, only influences the transmission of the ink or moistening agent negligibly, but on the other hand causes an intensive lateral trituration. As a result of the continual reversal of the direction of trituration, impacts on the lateral machine housings, and thus vibrations, are avoided.

In an advantageous development of the invention, adjustment bearings are positioned in the levers to change the axle distance between the two rollers. As a result, the adjusting pressure of the friction roller on to the next roller can be fine-tuned. It is also advantageous for the step-down gear system to be designed as a toothed belt drive, requiring minimal technological expenditure, permitting any desired step-down ratios and whereby the swivelling movement of the friction roller cannot have a negative effect.

BRIEF DESCRIPTION OF THE DRAWINGS

We turn now to a detailed description of a preferred embodiment of the invention, after first briefly describing the drawings, wherein.

DESCRIPTION OF THE PREFERRED EMBODIMENTS

Figure 1:
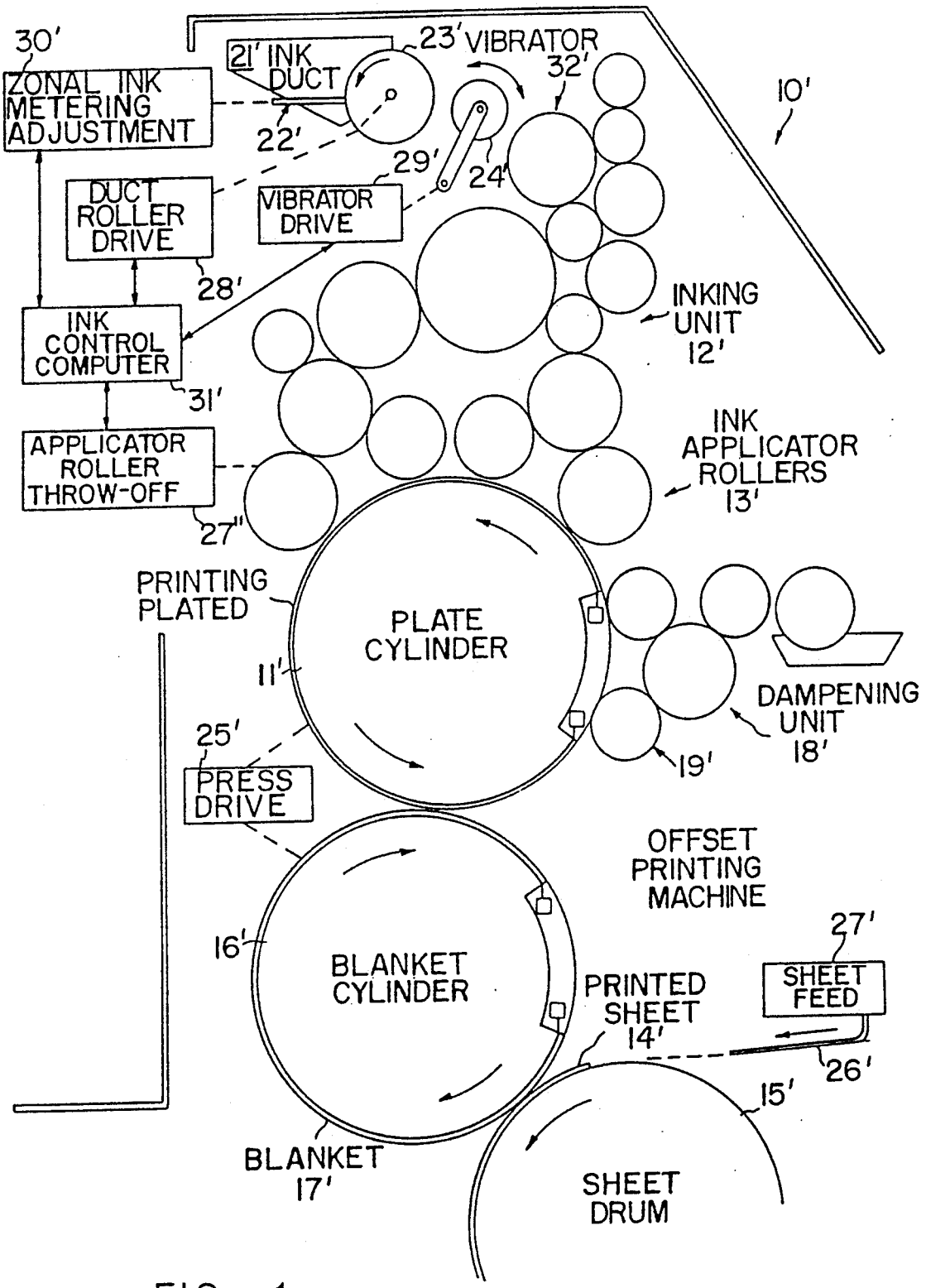
FIG. 1 PRIOR ART
FIG. 1 is a schematic side view of an offset printing press known in the prior art for which the friction roller according to the present invention is suitable in conjunction therewith.
Figure 2:
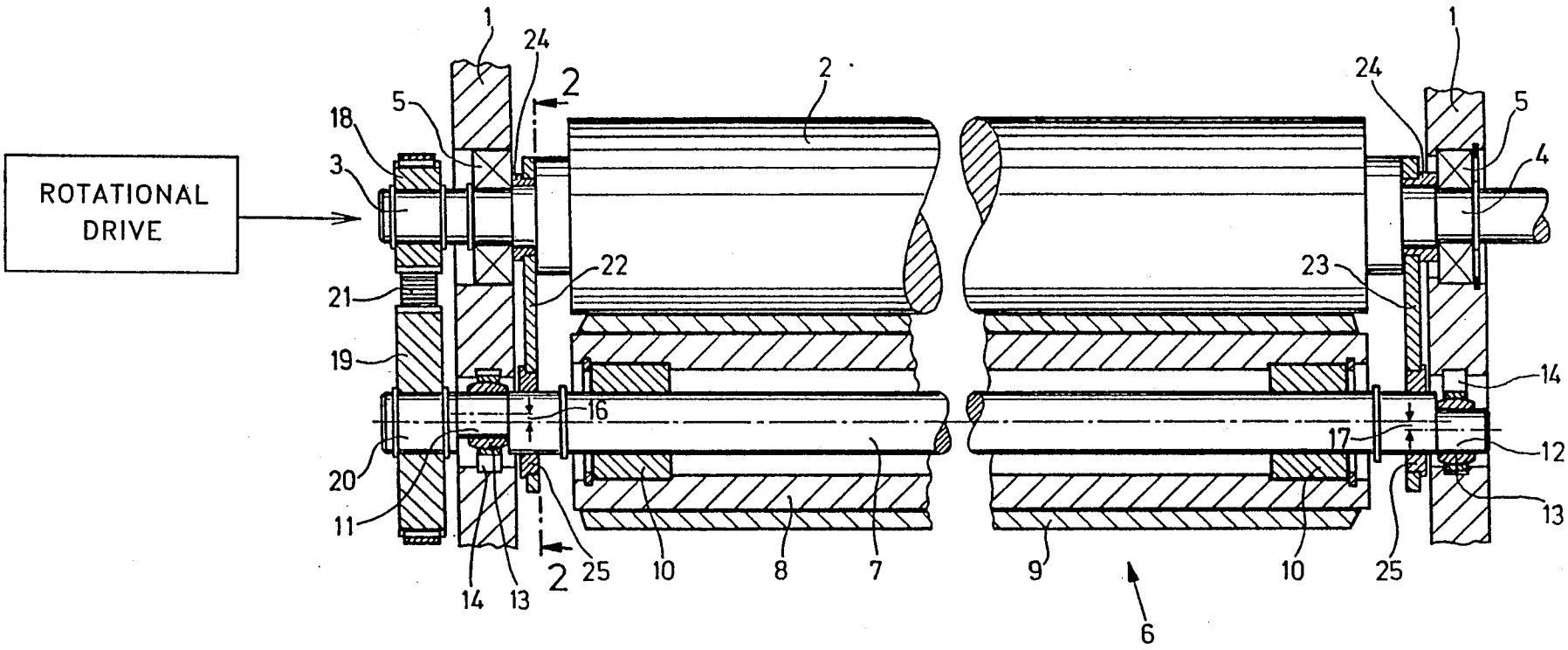
FIG. 2 is a longitudinal sectional view through a friction roller constructed according to the invention.

Referring first to FIG. 1, a fairly conventional offset printing press 10' known to the art generally includes: a plate cylinder 11' for receiving the mounting thereon of a printing plate D; a blanket cylinder 16', which has mounted thereon a blanket 17'; a sheet drum 15'; an inking unit 12'; and a dampening (or wetting) unit 18'. Sheets of paper 14' and 26', upon which material is to be printed, are supplied by a sheet feed mechanism 27'.

Ink for the printing process is supplied from an ink reservoir 21' through an ink duct metering device 22' to an ink ductor roller 23'. A reciprocating vibrator roller 24' transfers zonally adjusted quantities of ink from the ink ductor roller 23' to a preliminary introductory inking roller 32' of the inking unit 12'. The thus introduced ink travels through the various rollers of the inking unit 12' until it reaches the ink applicator rollers 13' which are in contact with the plate cylinder 11' for the transfer of the ink thereto.

Typically, the appropriate dosing of ink for the various inking zones extending transversely across the printing press will be monitored and adjusted by a central control apparatus 31', which will control the zonal adjustment of the ink ducts 30', the ink ductor roller drive 28' and the drive 29' for the reciprocating vibrator roller. Additionally, typically, such a central control device 31' will control provided circuitry 27'' for the separation of the ink applicator rollers 13' from the surface of the printing plate D.

The wetting unit 18' will typically include at least one wetting agent applicator roller 19' for applying the wetting agent to the surface of the printing plate D.

Also, the printing press 10' will conventionally include a press drive 25' for rotationally driving various of those rollers described above, for example, the plate cylinder 11', the blanket cylinder 16', and various other rollers within the inking unit or wetting unit chains of rollers.

Referring to the remainder of the above-described drawings, between the lateral machine housings (or side frames) of a printing press 1, an inking or moistening unit roller 2 is mounted, which is driven by a conventional drive means (shown as Rotational Drive). The inking or moistening unit roller 2 is provided with machined roller journals 3 and 4, which are positioned within roller bearings 5 mounted in the lateral machine housings 1.

A provided friction roller 6 includes a roller axle 7 and a roller body 8, which is preferably provided with a rubber casing 9. The roller body 8 is driven by the inking or moistening unit roller 2 by means of a frictional engagement therewith, and is mounted such that it can be rotated on the roller axle 7 by being fitted over provided mountings 10, and such that it can be displaced axially. The mountings 10 are preferably, for example, needle bearings, which preferably have an extended inner ring, thereby allowing such longitudinal displacement.

Figure 3:
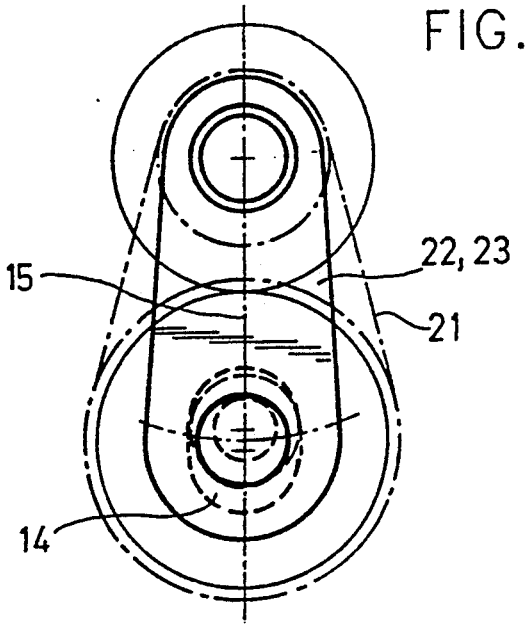
FIG. 3 is a partial cross-sectional view of the friction roller.
Figure 4:
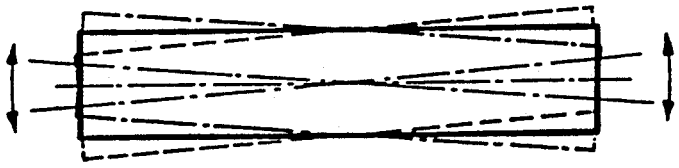
FIG. 4 is an elevational view showing the pendulum movement of the friction roller.
Figure 5:
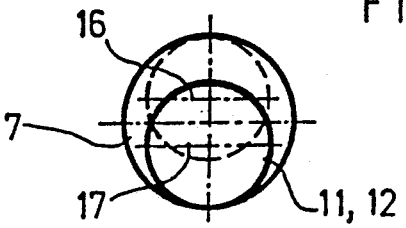
FIG. 5 is an elevational view showing eccentric positioning of the eccentric bearings.

The opposing ends of the roller axle 7 are provided with eccentrically designed rotational bearing surfaces 11 and 12 in the area of the lateral machine housings 1. Rocker bearings 13 encircle the eccentrically designed rotational bearing surfaces 11 and 12, and are positioned within preferably circular throughgoing openings provided in the lateral machine housings 1. The outer rings of the rocker bearings 13 are guided in slot guides 14, which are recessed into the interior annular surfaces of the circular throughgoing openings provided in the lateral machine housings 1. The effect of the slots 14 is that the action of the eccentric rotational bearing surfaces 11 and 12 causes a pendulum movement of the friction roller 6, which has the effect of torsion against the inking or moistening unit roller 2, without any change in the adjusting pressure. For this purpose, the slots 14 run parallel to the center line 15 between the friction roller 6 and the inking or moistening unit roller 2 interacting therewith. The eccentricity 16 of the eccentric bearing 11 is offset in the opposite direction to the eccentricity 17 of the eccentric bearing 12, that is, the eccentricity 16 of the bearing 11 is offset, preferably by 180°, from the eccentricity 17 of the bearing 12. In other words, the eccentricities of bearings 11 and 12 are 180° out of phase with respect to one another. As is shown in FIG. 3, this results in a pendulum movement, wherein the pivot point of the roller body 8 remains in constant contact with the inking or moistening unit roller 2.

The rotational drive of the roller axle 7 is preferably achieved via a step-down gear system, consisting of a drive wheel 18, which is secured to the roller journal of the inking or moistening unit roller 2, and a driven wheel 19, which is fastened to the journal 20 of the roller axle 7. The connection of the two wheels 18 and 19 is preferably effected by a toothed belt 21. Preferably the toothed belt 21 may be elastic, e.g., rubber. Moreover, preferably the diameter ratios of wheels 18 and 19 are designed such that the roller axle 7 turns at a lower rotational speed than the inking or moistening roller 2. Thus, the frequency of the lateral trituration can be changed according to the step-down ratio. That is, the stroke frequency can be adjusted by varying the ratio of the diameters of the wheels 18 and 19. The eccentricities 16 and 17 determine the magnitude of the lateral stroke of the roller body 8 on the roller axle 7, i.e., the greater the eccentricity, the greater the inclination of the friction roller 6 and thus the greater the lateral stroke executed in the time provided by the particular step-down chosen through the selection of the diameter ratio of gears 18 and 19.

On both sides of the printing press, in the area of the lateral machine housings 1, levers 22 and 23 are provided which are preferably mounted, either over slide bearings 24 provided on the roller journals 3, 4 of the inking or moistening roller 2, or on their respective bearing supports. In the latter case, the levers 22 and 23 are preferably mounted for relatively free rotational movement thereabout, such that the levers 22 and 23 do not impede the movement of the friction roller 6. At their opposite ends, the levers 22 and 23 encircle the roller axle 7 and are provided with mounting plates 25, which are preferably, in certain embodiments, designed eccentrically, thereby allowing a selective variation of the adjusting pressure between the two rollers. These mountings may also, for example, be designed as slide bearings. By means of changes in the center-to-center distance between the two rollers, the adjusting pressure can be suited to the technological printing requirements via the mountings 25.

Utilizing the construction described above, a controlled lateral stroke movement of the friction roller 6 is possible, whereby, through selection of a specific eccentricity 16 and 17, the intensity of the lateral stroke movement can be suited to the particular printing requirements, and the stroke frequency can also be suited to the particular printing requirements by changing the diameter ratios of the two wheels 18 and 19. If a continuous set of gears or, for example, a variable speed transmission, is used, instead of the toothed belt drive described above, the stroke frequency can also be changed while the printing press is running.

In other words, the construction for a friction roller as described above provides means for independently changing the stroke (i.e., the amount of displacement of the friction roller), the frequency with which such stroke is executed, and the degree of pressure exerted by the friction roller on the inking unit roller or wetting unit roller by which it is driven.

As presently understood, it appears that the eccentricities 16 and 17 of the friction roller journals 11 and 12, respectively, cause the friction roller axle 7 to execute a wobbling motion about approximately the center point of the longitudinal axis of the friction roller axle 7. Such a wobbling mode of action is accommodated by the rocker bearings 13 which, in turn, execute an orbital motion following the annular slots 14 provided in the side frames 1 of the printing press. Such wobbling motion of the friction roller 6 and orbital motion of the rocker bearings 13 within the annular slots 14 is also accommodated by the preferable use of an elastic (e.g., rubber) toothed belt 21. The provision of the lever arms 22 and 23, preferably having exchangeable rotational bearing inserts 25 allows, through the replacement of one plate 25 with another having a differently located throughgoing bearing aperture, a selectable variation of the pressure exerted between the two rollers.

The wobbling motion executed by the friction roller according to the present invention has been found to be a particularly efficacious means of effecting a thorough mixing and distribution of the ink and/or wetting agent employed. It will be appreciated that such a wobbling action of the friction roller 6 could also be achieved merely by mounting the friction roller axle 7, having oppositely offset eccentric rotational bearing surfaces 11 and 12, directly within journals provided either in or on the side frame members 1. Additionally, in both constructions, various selective strokes (i.e., displacements) can be achieved merely by exchanging the friction roller shaft 7 for another similar roller shaft 7 having different eccentricities 16 and 17.

In summary, one feature of the invention resides broadly in a friction roller for the inking or moistening unit of printing machines, whose roller axle is mounted on the lateral housings, and whose body is driven through frictional engagement by an inking or moistening unit roller, executing a to-and-fro movement on the roller axle in its rotation movement, characterized by the facts that in the area of the lateral machine housings 1, the roller axle 7 features eccentric bearings 11, 12 whose eccentricity 16, 17 is offset in the opposite direction by 180 degrees; that on the eccentric bearings 11, 12 rocker bearings 13 are provided which run in a slot guide 14 parallel to the central unit 15 between the friction roller 6 and the interacting inking or moistening roller 2; that in the area of the lateral machine housings 1, levers 22, 23 are provided on both sides which are mounted swivellably on the mounting of the inking or moistening roller 2 and which encompass the roller axle 7 at the opposite end in order to create the adjusting pressure; and that the roller axle 7 is driven via a step-down gear system 18, 19 by the inking or moistening roller 2.

Another feature of the invention resides broadly in the friction roller as described above, further characterized by the fact that an adjustment bearing 25 is positioned in the levers 22, 23 to change the axle distance between the two rollers 2, 6.

Yet another feature of the invention resides broadly in the friction roller as described above, still further characterized by the fact that the step-down gear system 18, 19 is designed as a toothed belt drive.

All of the patents, patent applications, and publications recited herein, if any, are hereby incorporated by reference as if set forth in their entirety herein.

The invention as described hereinabove in the context of the preferred embodiments is not to be taken as limited to all of the provided details thereof, since modifications and variations thereof may be made without departing from the spirit and scope of the invention.

What is claimed is:

1. A friction roller for a printing press, the printing press comprising:

a pair of side frame members;

a plate cylinder for receiving the mounting thereon of a printing plate;

an ink reservoir for supplying an ink;

at least one ink transfer roller for transferring the ink between the ink reservoir and the printing plate mounted on the plate cylinder;

a wetting agent reservoir for supplying a wetting agent; and at least one wetting agent transfer roller for transferring the wetting agent between the wetting agent reservoir and the printing plate mounted on the plate cylinder;

said friction roller comprising:

a cylindrical exterior surface;

an elongated axle member having an extended longitudinal axis, a first end and a second end;

a first rotational bearing surface provided on said first end of said axle member;

said first rotational bearing surface being supported by a first of the pair of side frame members, and said first rotational bearing surface comprising first rotational bearing means for permitting rotation of said axle member, with respect to the first side frame member and about said extended longitudinal axis; and a second rotational bearing surface provided on said second end of said axle member;

said second rotational bearing surface being supported by a second of the pair of side frame members, and said second rotational bearing surface comprising second rotational bearing means for permitting rotation of said axle member, about said extended longitudinal axis and with respect to the second of the pair of side frame members;

said first rotational bearing surface being displaced by a first offset from said extended longitudinal axis of said axle member in a direction substantially perpendicular to said extended longitudinal axis of said axle member; and said second rotational bearing surface being displaced by a second offset from said extended longitudinal axis of said axle member in a direction substantially perpendicular to said extended longitudinal axis of said axle member;

said substantially perpendicular first and second offsets being in substantially opposite directions from said longitudinal axis of said axle member;

first rocker bearing means for accommodating a first at least partially orbital motion of said first rotational bearing surface; and second rocker bearing means for accommodating a second at least partially orbital motion of said second rotational bearing surface;

wherein the printing press additionally comprises an elongated ink transfer roller axle mounted between the pair of side frame members, the ink transfer roller being positioned about the ink transfer roller axle, and an elongated wetting agent transfer roller axle mounted between the pair of side frame members, the wetting agent transfer roller being positioned about the wetting agent transfer roller axle, and wherein said friction roller additionally comprises:

a first lever arm having a first end rotationally mounted about at least one of the ink transfer roller axle and the wetting agent transfer roller axle, said first lever arm also having a second end being positioned adjacent and surrounding said first end of said elongated axle member of said friction roller; and a second lever arm having a first end rotationally mounted about at least one of the ink transfer roller axle and the wetting agent transfer roller axle, said second lever arm also having a second end being positioned adjacent and surrounding said second end of said elongated axle member of said friction roller.

2. A friction roller according to claim 1, wherein the printing press further comprises drive means for rotationally driving the ink transfer roller axle, and wherein said friction roller additionally comprises transmission drive means for transmitting rotational drive from the ink transfer roller to said elongated axle member of said friction roller, said elongated axle member of said frictional roller being driven at a rotational speed less than the rotational speed of the ink transfer roller axle.

3. A friction roller according to claim 2, wherein said transmission drive means comprises a toothed belt, and further comprising means for constraining said cylindrical exterior surface of said friction roller against substantial axial movement with respect to said elongated axle member of said friction roller.

4. A friction roller according to claim 3, wherein said first rocker bearing means comprises a first aperture formed in the first side frame member, a first annular bearing member surrounding said first rotational bearing surface and positioned within said first aperture, a first annular recess formed about the interior of said first aperture, and a first outstanding flange formed on the exterior of said first annular bearing member, said first outstanding flange being positioned within said first annular recess; and wherein said second rocker bearing means comprises a second aperture formed in the second side frame member, a second annular bearing member surrounding said second rotational bearing surface and positioned within said second aperture, a second annular recess formed about the interior of said second aperture, and a second outstanding flange formed on the exterior of said second annular bearing member, said second outstanding flange being positioned within said second annular recess;

and wherein said means for constraining comprises a first substantially planar surface extending outward from said first rotational bearing surface and abutting said first annular bearing member, and a second substantially planar surface extending outward from said second rotational bearing surface and abutting annular bearing member.

5. A friction roller according to claim 4, wherein said toothed belt is elastic.

6. A friction roller according to claim 1, wherein the printing press further comprises drive means for rotationally driving the wetting agent transfer roller axle, and wherein said friction roller additionally comprises transmission drive means for transmitting rotational drive from the wetting transfer roller to said elongated axle member of said friction roller, said elongated axle member of said frictional roller being driven at a rotational speed less than the rotational speed of the wetting agent transfer roller axle.

7. A friction roller according to claim 6, wherein said transmission drive means comprises a toothed belt and further comprising means for constraining said cylindrical exterior surface of said friction roller against substantial axial movement with respect to said elongated axle member of said friction roller.

8. A friction roller according to claim 7, wherein said toothed belt is elastic.

9. A friction roller according to claim 5, said friction roller additionally comprising a plurality of first bearing plates for attachment to said first lever arm and about said first end of said axle member of said friction roller, each of said plurality of first bearing plates determining a different distance between said first end of said axle member of said friction roller and the ink transfer roller axle member, and a plurality of second bearing plates for attachment to said second lever arm and about said second end of said axle member of said friction roller, each of said plurality of second bearing plates determining a different distance between said second end of said axle member of said friction roller and the ink transfer roller member.

10. A friction roller according to claim 9, said friction roller additionally comprising a plurality of first bearing plates for attachment to said first lever arm and about said first end of said axle member of said friction roller, each of said plurality of first bearing plates determining a different distance between said first end of said axle member of said friction roller and the wetting agent transfer roller axle member, and a plurality of second bearing plates for attachment to said second lever arm and about said second end of said axle member of said friction roller, each of said plurality of second bearing plates determining a different distance between said second end of said axle member of said friction roller and the wetting agent transfer roller member.

11. A friction roller for a printing press, the printing press comprising:

a pair of side frame members;

a plate cylinder for receiving the mounting thereon of a printing plate;

an ink reservoir for supplying an ink;

at least one ink transfer roller for transferring the ink between the ink reservoir and the printing plate mounted on the plate cylinder;

a wetting agent reservoir for supplying a wetting agent; and at least one wetting agent transfer roller for transferring the wetting agent between the wetting agent reservoir and the printing plate mounted on the plate cylinder;

said friction roller comprising:

an elongated axle member having an extended longitudinal axis, a first end and a second end;

a first rotational bearing surface provided on said first end of said axle member;

said first rotational bearing surface being supported by a first of the pair of side frame members, and said first rotational bearing surface comprising first rotational bearing means for permitting rotation of said axle member, with respect to the first side frame member and about said extended longitudinal axis; and a second rotational bearing surface provided on said second end of said axle member;

said second rotational bearing surface being supported by a second of the pair of side frame members, and said second rotational bearing surface comprising second rotational bearing means for permitting rotation of said axle member, about said extended longitudinal axis and with respect to the second of the pair of side frame members;

said first rotational bearing surface being displaced by a first offset from said extended longitudinal axis of said axle member in a direction substantially perpendicular to said extended longitudinal axis of said axle member and;

said second rotational bearing surface being displaced by a second offset from said extended longitudinal axis of said axle member in a direction substantially perpendicular to said extended longitudinal axis of said axle member;

said substantially perpendicular first and second offsets being in substantially opposite directions from said longitudinal axis of said axle member.

first rocker bearing means for accommodating a first orbital motion of said first rotational bearing surface;

second rocker bearing means for accommodating a second orbital motion of said second rotational bearing surface;

wherein said first rocker bearing means comprises a first aperture formed in the first side frame member, a first annular bearing member surrounding said first rotational bearing surface and positioned within said first aperture, a first annular recess formed about the interior of said first aperture, and a first outstanding flange formed on the exterior of said first annular bearing member, said first outstanding flange being positioned within said first annular recess; and wherein said second rocker bearing means comprises a second aperture formed in the second side frame member, a second annular bearing member surrounding said second rotational bearing surface and positioned within said second aperture, a second annular recess formed about the interior of said second aperture, and a second outstanding flange formed on the exterior of said second annular bearing member, said second outstanding flange being positioned within said second annular recess.

12. A friction roller according to claim 11, wherein the printing press additionally comprises an elongated ink transfer roller axle mounted between the pair of side frame members, the ink transfer roller being positioned about the ink transfer roller axle, and wherein said friction roller additionally comprises:

a first lever arm rotationally mounted about the ink transfer roller axle, said first lever arm being positioned adjacent and surrounding said first end of said elongated axle member of said friction roller; and a second lever arm rotationally mounted about the ink transfer roller axle, said second lever arm being positioned adjacent and surrounding said second end of said elongated axle member of said friction roller.

13. A friction roller according to claim 11, wherein the printing press additionally comprises an elongated wetting agent transfer roller axle mounted between the pair of side frame members, the wetting agent transfer roller being positioned about the wetting agent transfer roller axle, and wherein said friction roller additionally comprises:

a first lever arm rotationally mounted about the wetting agent transfer roller axle, said first lever arm being positioned adjacent and surrounding said first end of said elongated axle member of said friction roller; and a second lever arm rotationally mounted about the wetting agent transfer roller axle, said second lever arm being positioned adjacent and surrounding said second end of said elongated axle member of said friction roller.

14. A friction roller according to claim 12, wherein the printing press further comprises drive means for rotationally driving the ink transfer roller axle, and wherein said friction roller additionally comprises transmission drive means for transmitting rotational drive from the ink transfer roller to said elongated axle member of said friction roller, said elongated axle member of said frictional roller being driven at a rotational speed less than the rotational speed of the ink transfer roller axle.

15. A friction roller according to claim 14, wherein said transmission drive means comprises a toothed belt.

16. A friction roller according to claim 15, wherein said toothed belt is elastic.

17. A friction roller according to claim 13, wherein the printing press further comprises drive means for rotationally driving the wetting agent transfer roller axle, and wherein said friction roller additionally comprises transmission drive means for transmitting rotational drive from the wetting transfer roller to said elongated axle member of said friction roller, said elongated axle member of said frictional roller being driven at a rotational speed less than the rotational speed of the wetting agent transfer roller axle.

18. A friction roller according to claim 17, wherein said transmission drive means comprises a toothed belt.

19. A friction roller according to claim 18, wherein said toothed belt is elastic.

20. A friction roller according to claim 16, said friction roller additionally comprising a plurality of first bearing plates for attachment to said first lever arm and about said first end of said axle member of said friction roller, each of said plurality of first bearing plates determining a different distance between said first end of said axle member of said friction roller and the ink transfer roller axle member, and a plurality of second bearing plates for attachment to said second lever arm and about said second end of said axle member of said friction roller, each of said plurality of second bearing plates determining a different distance between said second end of said axle member of said friction roller and the ink transfer roller member.

21. A friction roller according to claim 19, said friction roller additionally comprising a plurality of first bearing plates for attachment to said first lever arm and about said first end of said axle member of said friction roller, each of said plurality of first bearing plates determining a different distance between said first end of said axle member of said friction roller and the wetting agent transfer roller axle member, and a plurality of second bearing plates for attachment to said second lever arm and about said second end of said axle member of said friction roller, each of said plurality of second bearing plates determining a different distance between said second end of said axle member of said friction roller and the wetting agent transfer roller member.

* * * * *

UNITED STATES PATENT AND TRADEMARK OFFICE

CERTIFICATE OF CORRECTION

PATENT NO. : 5,107,761

DATED : April 28, 1992

INVENTOR(S) : Martin GREIVE

It is certified that error appears in the above-identified patent and that said Letters Patent is hereby corrected as shown below:

On the title page, under the Inventor section, item 75, after 'Greive', delete "Am Bächenbuckel" and insert --Heidelberg--.

Signed and Sealed this

Thirty-first Day of August, 1993

Bruce Lehman

*Attest:*

BRUCE LEHMAN

*Attesting Officer*

*Commissioner of Patents and Trademarks*